US005181691A

United States Patent [19]

Taniguchi et al.

[11] Patent Number: 5,181,691

[45] Date of Patent: Jan. 26, 1993

[54] MECHANICAL PART MADE OF CERAMICS

[75] Inventors: Masato Taniguchi; Juzo Yagi; Hiroshi Takeda, all of Aichi, Japan

[73] Assignee: NGK Spark Plug Co., Ltd., Nagoya, Japan

[21] Appl. No.: 718,566

[22] Filed: Jun. 20, 1991

Related U.S. Application Data

[62] Division of Ser. No. 613,002, Nov. 15, 1990, Pat. No. 5,052,352, which is a division of Ser. No. 318,766, Mar. 3, 1989, abandoned.

[30] Foreign Application Priority Data

Mar. 9, 1988 [JP] Japan ..... 63-55418

[51] Int. Cl.[5] ..... F16K 5/00

[52] U.S. Cl. ..... 251/315; 428/141; 428/167; 428/179; 428/409; 428/410; 428/426; 428/457; 428/472; 251/368; 137/237

[58] Field of Search ..... 428/141, 167, 179, 409, 428/410, 426, 457, 472; 251/368, 315; 137/237

[56] References Cited

U.S. PATENT DOCUMENTS

| | | | |
|---|---|---|---|
| 4,343,479 | 9/1982 | Fukuoka et al. | 277/96.2 |
| 4,771,803 | 9/1988 | Berchem et al. | 251/368 |
| 4,983,468 | 1/1991 | Oda | 428/62.1 |

*Primary Examiner*—Robinson, Ellis P.
*Assistant Examiner*—William P. Watkins, III
*Attorney, Agent, or Firm*—Foley & Lardner

[57] ABSTRACT

A mechanical part has a contact surface for movement on a mating surface. The contact surface is first rough ground by using a grinding wheel of a grain size, for example, equal to or smaller than #200 and then barrel finished or buffed so as to have such a profile that is roughness spacing ranges from 5 to 100 μm and more than half of its peaks are smoothly rounded.

1 Claim, 7 Drawing Sheets

SURFACE CHARACTERISTICS

FIG.13

| ROCKER ARM SAMPLING NO. | GRINDING CONDITION | SURFACE CHARACTERISTICS | RESULT OF TEST FOR WEAR |
|---|---|---|---|
| 1 | BARREL FINISHED AFTER GROUND BY GRINDING WHEEL WHOSE GRAIN SIZE IS #110 | SHOWN IN FIG.3 | WEAR OF CAM : EQUAL TO OR SMALLER THAN 5 μm |
| 11 | BARREL FINISHED AFTER GROUND BY GRINDING WHEEL WHOSE GRAIN SIZE IS #400 | SHOWN IN FIG.4 | WEAR OF CAM : EQUAL TO OR SMALLER THAN 5 μm |
| R1 | GROUND BY GRINDING WHEEL WHOSE GRAIN SIZE #400 | SHOWN IN FIG.5 | WEAR OF CAM : 60μm |
| R2 | FINISH GROUND BY GRINDING WHEEL WHOSE GRAIN SIZE IS #600 AFTER ROUGH GROUND BY GRINDING WHEEL WHOSE GRAIN SIZE IS #110 | SHOWN IN FIG.6 | WEAR OF CAM : 10μm |

FIG.14

| BALL VALVE SAMPLING NO. | GRINDING CONDITION | SURFACE CHARACTERISTICS | RESULT OF TEST FOR WEAR |
|---|---|---|---|
| 23 | BARREL FINISHED AFTER GROUND BY GRINDING WHEEL WHOSE GRAIN SIZE IS #200 Ra = 0.43 | SHOWN IN FIG.9 | WEAR OF SEAL : EQUAL TO OR SMALLER THAN 0.5 μm |
| R3 | GROUND BY GRINDING WHEEL WHOSE GRAIN SIZE IS #200 Ra = 0.55 | SHOWN IN FIG.10 | WEAR OF SEAL : 80 μm IN MAXIMUM<br>LARGE FLAWS AND LEAKAGE OF FLUID ARE CAUSED. |
| R4 | FINISH GROUND BY GRINDING WHEEL WHOSE GRAIN SIZE #1000 AFTER ROUGH GROUND BY GRINDING WHEEL WHOSE GRAIN SIZE IS #200 Ra = 0.14 | SHOWN IN FIG.11 | WEAR OF SEAL : EQUAL TO OR SMALLER THAN 0.5 μm |

MECHANICAL PART MADE OF CERAMICS

This application is a division of application Ser. No. 07/613,002, filed Nov. 15, 1990, now U.S. Pat. No. 5,052,352, filed Oct. 1, 1991, which is a division of application Ser. No. 07/318,766, filed Mar. 3, 1989, now abandoned.

BACKGROUND OF THE INVENTION

I. Field of the Invention

The present invention relates to a mechanical part made of ceramics as a rocker arm, ball valve, tappet, piston, etc. for an automotive engine.

II. Background of the Invention

In the case of an automotive engine part, the positional and form tolerances are severely limited. For this reason, it is necessary to grind the contact surface of the part in order to remove the distorsion caused by baking or firing. In this instance, a grinding wheel of a relatively coarse grain size of #200 or so (according to Japanese Industrial Standards) is used in order to increase the cutting rate.

However, when the contact surface of the part is ground coarse or rough, the actual contact area of the part becomes small. This causes an increased surface pressure and wear of a mating surface of another mechanical part which is made of metal equal to or lower in mechanical property than ceramics. In order to prevent this, a grinding wheel of a finer grain size is used to finish grind the contact surface and thereby reduce the roughness height and spacing after shaping and sizing of the mechanical part by a grinding wheel of a coaser grain size.

A problem of the prior art grinding process is that it is not suited for mass production since each mechanical part must be not only rough ground but finish ground independently, i.e., both of rough grinding and finish grinding must be made to the parts one by one.

Another problem is that the mechanical part which is finish ground according to the prior art grinding process has a difficulty of holding lubricant on its contact surface due to the small roughness height and spacing.

SUMMARY OF THE INVENTION

In accordance with the present invention, there is provided a mechanical part made of ceramics. The mechanical part comprises a contact surface for movement on a mating surface. The contact surface has such a profile that its roughness spacing ranges from 5 to 100 μm and its peaks are smoothly rounded.

In accordance with the present invention, there is further provided a method of finishing a contact surface of a mechanical part made of ceramics. The method comprises rough grinding the contact surface in such a way that the contact surface has such a profile that its roughness spacing ranges from 5 to 100 μm and processing the contact surface in such a way that peaks of the profile are smoothly rounded.

The above structrue and method are effective for solving the above noted problems inherent in the prior art.

It is accordingly an object of the present invention to provide an improved mechanical part made of ceramics which can reduce the manufacturing cost.

It is another object of the present invention to to provide a mechanical part of the above described character which is suited for mass production.

It is a further object of the present invention to provide a mechanical part of the above described character which can increase its surface area for contact with a mating surface without requiring a finish grinding process using a grinding wheel of a fine grain size.

It is a further object of the present invention to provide a mechanical part of the above described character which can hold lubricant on its contact surface with an improved efficiency.

BRIEF DESCRIPTION OF THE DRAWINGS

FIG. 13 is a table showing grinding condition, surface characteristics and test results for rocker arm samples; and FIG. 14 is a table showing grinding condition, surface characteristics and test results for ball valve samples.

DESCRIPTION OF THE PREFERRED EMBODIMENTS

Figure 1:
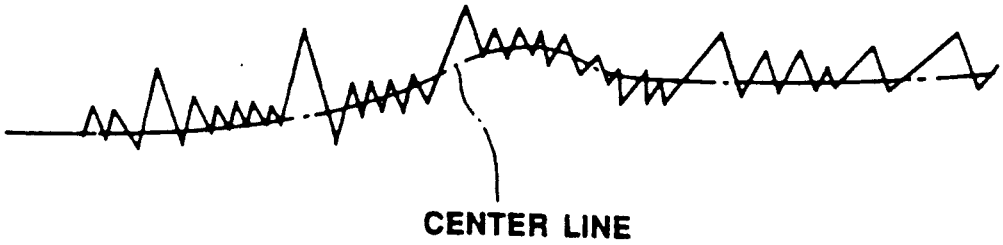
FIG. 1 is a measured profile of a mechanical part, illustrating an important feature of the present invention.
Figure 12:
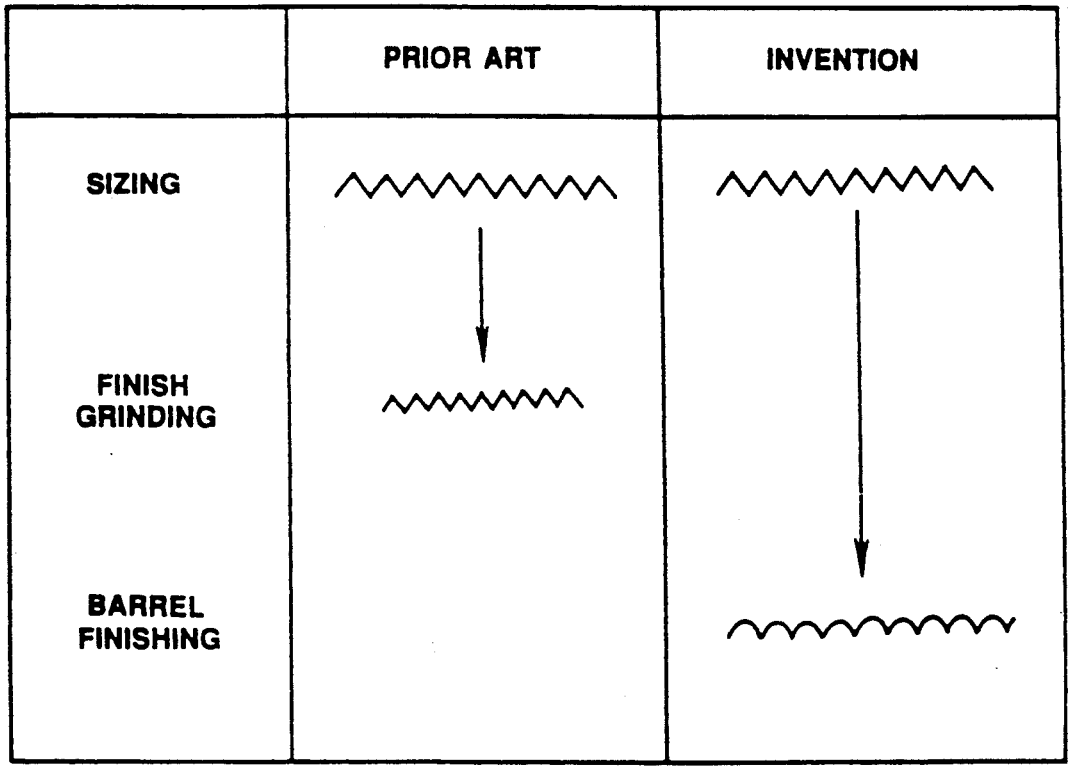
FIG. 12 is a table comparing surface characteristics between this invention and the prior art.

A mechanical part according to the present invention has a contact surface which includes a smoothly rounded peak when viewed in a measured profile as shown in FIG. 1. The difference in surface characteristics between this invention and the prior art is also shown in FIG. 12. By this, even when the surface roughness measured by an instrument is coarse or rough, a relatively large contact area is obtained, thus making it possible to reduce its surface pressure and thereby prevent the mating surface from being subjected to stress concentration at particular portions thereof. In contrast to this, the actual contact area of the prior art mechanical part is small even when the contact surface is ground to have a fine surface roughness. This is because the profile of the contact surface has pointed peaks, thus reducing the actual surface area for contact with a mating surface. For this reason, a stress concentration can not be avoided in the prior art mechanical part.

In this connection, it is desirable that all of the peaks are smoothly rounded or flattened. However, the heights of the peaks above the nominal profile (i.e., intended profile) differ from each other, and the peaks of the smaller heights have a smaller chance of contacting the mating surface. Thus, there is no necessity of smoothly rounding or flattening the peaks of the smaller heights. For the above reason, the present invention requires that more than half of the peaks be rounded.

Further, since the surface roughness of the mechanical part of this invention is relatively coarse or rough, it becomes possible to hold lubricant on its contact surface and thereby attain good lubrication thereof.

In the meantime, when the roughness spacing (i.e., the average spacing between the adjacent peaks of the measured profile) is smaller than 5 μm, it is difficult to hold lubricant on the contact surface. On the other hand, when, the roughness spacing exceeds 100 μm, it becomes impractical to reduce the surface pressure by increasing the surface area for contact with the mating surface.

A desired average height of rounded peaks in the mechancial part of this invention ranges from 0.5 to 2 μm. The mechanical part with such a surface roughness can be obtained by first grinding the part by using a coarse grinding wheel of a grain size smaller than #200 (according to Japanese Industrical Standards) and thereafter finished by barrel finishing, buffing or a similar surface finishing process so that the distances between the respective peaks and the center line, i.e., the heights of the peaks above the center line are respectively reduced by 30%.

Figure 2:
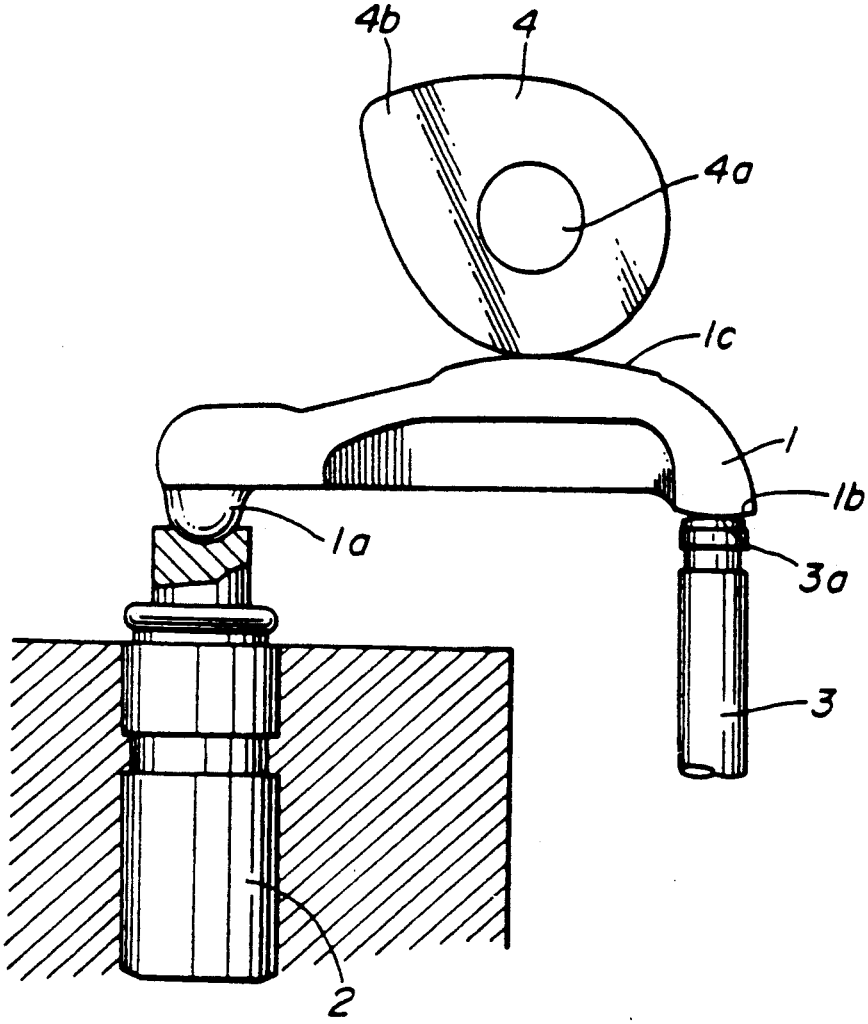
FIG. 2 is a side elevational view of a valve drive mechanism incorporating a ceramic rocker arm according to an embodiment of the present invention.
Figure 3:
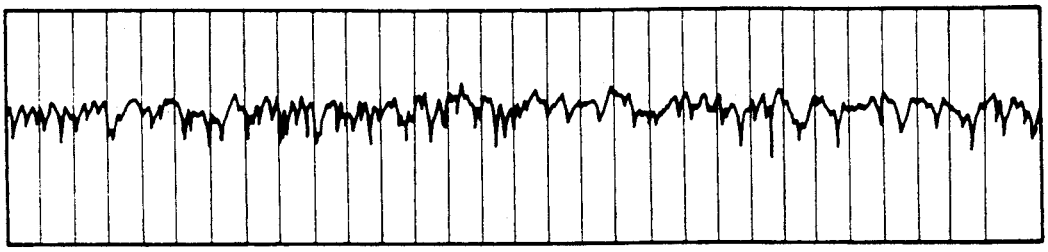
FIG. 3 is a pen recorder chart depicting the measured profile of the rocker arm of FIG. 2.
Figure 4:
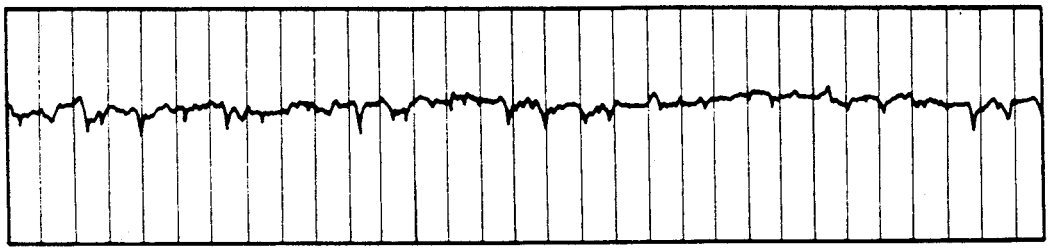
FIG. 4 is a pen recorder chart depicting the measured profile of a rocker arm sampling according to a variant of the present invention.
Figure 5:
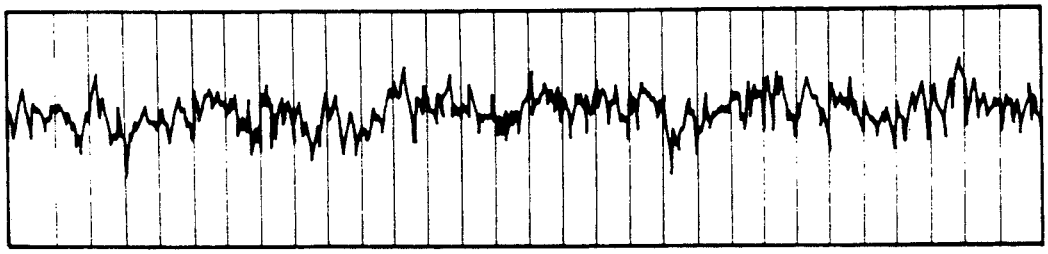
FIGS. 5 and 6 are views similar to FIGS. 3 and 4 but depicting the measured profiles of rocker arm samplings for comparision with the samplings of FIGS. 3 and 4.
Figure 6:
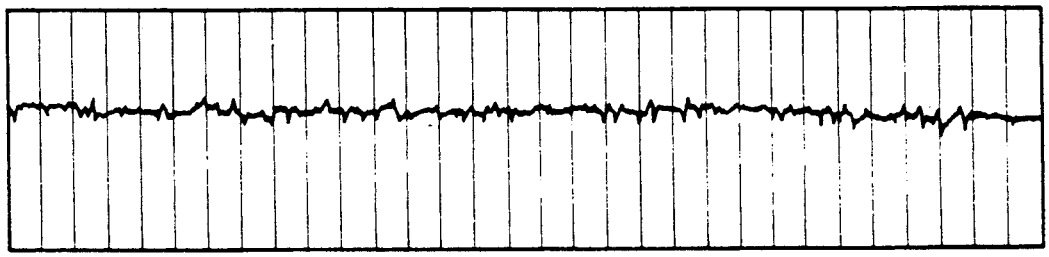

Referring to FIG. 2, a rocker arm for an automotive engine according to an embodiment of the present invention is indicated by the reference numeral 1 and made of ceramics as silicon nitride, silicon carbide, zirconia, etc. The rocker arm 1 has a pivot portion 1*a* in contact with a lash adjuster 2 and a sliding surface 1*b* in contact with a contact surface 3*a* of a valve stem 3. The rocker arm 1 further has a contact surface 1*c* in contact with a cam 4 made of chilled cast iron and rotatable with a camshaft 4*a*. The contact surface 1*c* is located on the side opposite to the pivot portion 1*a* and the contact surface 1*b* and intermediate between the same.

A compact for the rocker arm 1 is formed out of a material containing silicon nitride, baking assist agent and organic binder. After baking, the contact surface 1*c* with the cam 4 was ground under, the condition shown in FIG. 13, thereby completing the rocker arm 1. That is, as shown in FIG. 13, the contact surface 1*c* of the rocker arm 1 was first ground by using a grinding wheel of a grain size of #400 (according to Japanese Industrical Standards) and then barrel finished.

As seen from FIG. 13, rocker arm samplings 11, R1 and R2 were produced under the same condition as the rocker arm 1 except for the grinding condition. The rocker arms 1, 11, R1 and R2 were installed on an automotive engine and subjected to the test for the wear of the cam 4 at its cam lobe 4*b* under the condition that the camshaft 4*a* is rotated at the speed of 3000 rpm and for 200 hours. The test result is shown in FIG. 13, and the surface characteristics of the samplings 1, 11, R1 and R2 prior to the test are shown in FIGS. 3 to 6, respectively. As is apparent from FIG. 13 and FIGS. 3 to 6, the contact surfaces 1*c* of the rocker arms 1 and 11 according to the present invention in contact with the cam 4 have smoothly curved peaks when viewed in the measured profiles. Due to this, the wears of the cams contacting the rocker arms 1 and 11 are small.

In contrast to this, the contact surfaces of the rocker arms R1 and R2 which are not included within the scope of the present invention have pointed peaks when viewed in the measured profiles even after finish grinding, thus increasing the wear of the mating cam 4.

Figure 7:
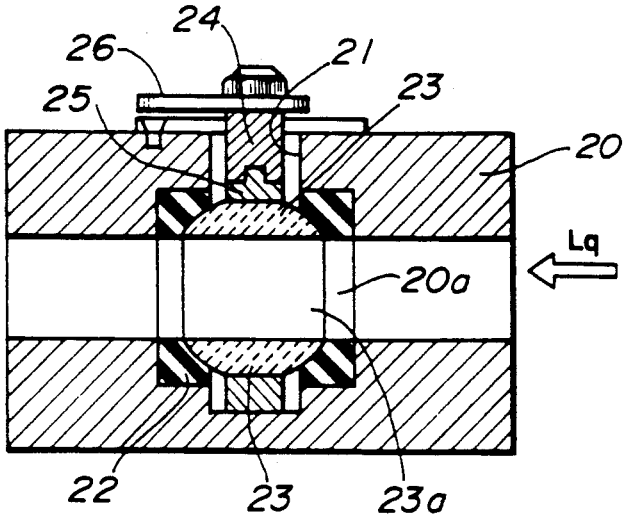
FIG. 7 is a sectional view of a ball valve according to another embodiment of the present invention.
Figure 8:
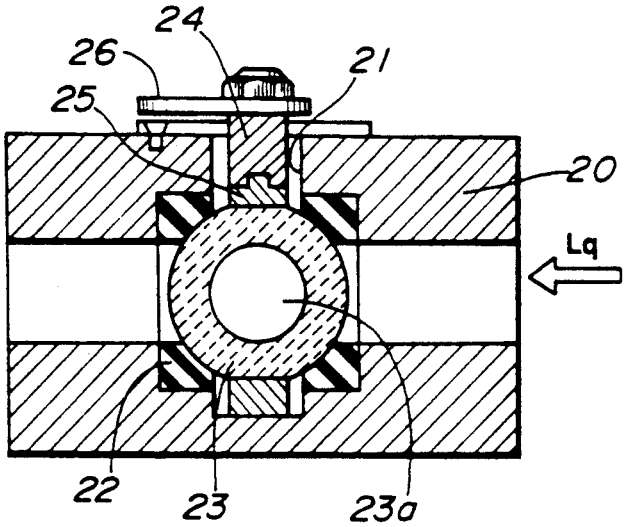
FIG. 8 is a view similar to FIG. 7 but showing the ball valve of FIG. 7 with respect to a different sectional plane.

Referring to FIGS. 7 and 8, a ball valve according to another embodiment is installed in a pipe 20 for conducting fluid "Lq" as liquid fuel. The pipe 20 is formed with a radial opening 21. The ball valve includes a tubular seal ring 22, composed of a steel alloy designated by the American Iron and Steel Institute as "AISIM-2", disposed in pipe 20. The tubular seal ring 22 has a fluid passage 20*a* aligned with the fluid passage (no numeral) of the pipe 20 and a radial opening (no numeral) axially aligned with the radial hole 21. The ball valve further includes a ball valve main body 23 made of ceramics as silicon nitride and disposed within the seal ring 22. The ball valve main body 23 has a ground outer periphery in sliding contact with the inner periphery of the seal ring 22 with a liquid tight seal therebetween and a communication passage 23*a* communicable with the fluid passage of the pipe 20 through the fluid passage 20*a*. A shaft 24 is disposed in the radial hole 21 and has a lower end attached to the ball valve main body 23 by way of a joint 25 and an upper end provided with a handle 26;

The ball valve is shown in FIG. 7 in its completely open state, i.e., in a state that the communication passage 23*a* of the ball valve main body 23 is axially aligned with the fluid passage of the pipe 20 for allowing passage of fluid through the ball valve. In this state, rotation of the handle 26 by 90° is transferred through the shaft 24 and the joint 25 to the ball valve main body 23, thus rotating by 90° the ball valve main body 23 into a position shown in FIG. 8. In the state of FIG. 8, the communication passage 23*a* and the, fluid passage 20*a* are positioned so as to axially intersect each other at right angles, thus obstructing passage of fluid therethrough, i.e., the ball valve is put in a completely closed sate. In response to the opening and closing operations, the outer periphery of the ball valve main body 23 slides on the inner periphery of the seal ring 22.

Figure 10:
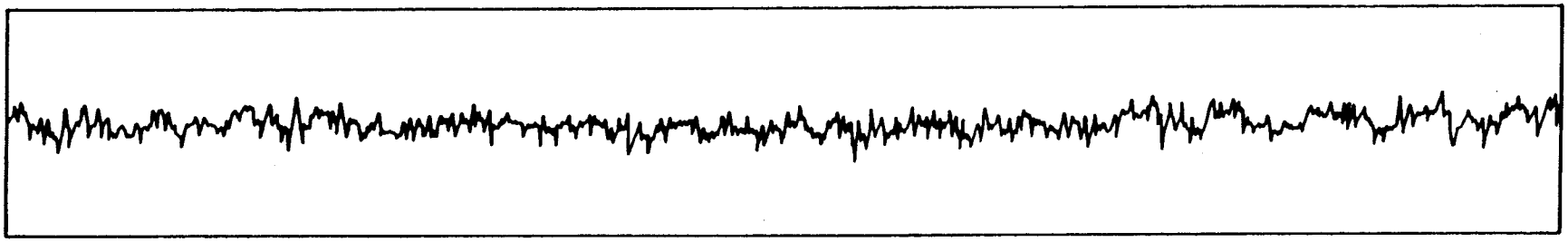
FIGS. 10 and 11 are pen recorder charts depicting the measured profiles of ball valve main body samplings for comparision with the sampling of FIG. 9
Figure 11:
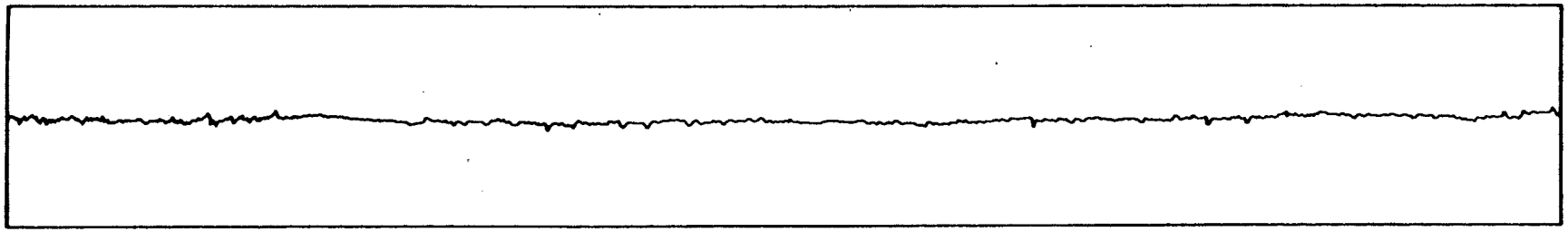

Experiments were conducted to the ball valve to test for wear under the condition that the surface pressure of the ball valve main body 23 was 5 kg/mm$^2$, the temperature of fluid was 500° C. and the pressure of fluid was 30 kg/cm$^2$. In this connection, ball valve main body samplings R3 and R4 were prepared for comparison with the ball valve main body 23 and differed from same only in the grinding condition. After 100 million times repetition of the opening and closing of the ball valve, the ball valve main bodies 23, R3 and R4 were removed to check the seal ring 22 for wear. The test result is shown in FIG. 14, and the surface characteristics of the samplings 23, R3, R4 prior to the test are shown in FIGS. 9, 10, and 11, respectively.

Figure 9:
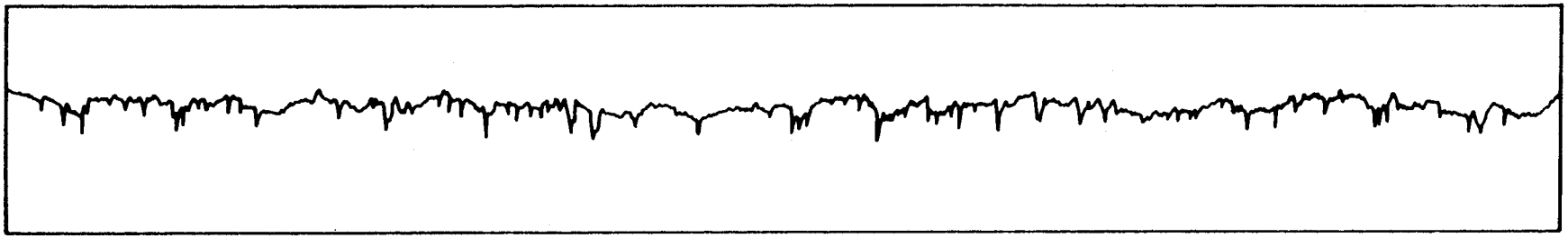
FIG. 9 is a pen recorder chart depicting a measured profile of the ball valve main body of FIGS. 7 and 8.

As seen from FIG. 14, the ball valve main body 23 was ground by a grinding wheel of a grain size of #200 (according to Japanese Industrial Standards) and then barrel finished so that the surface characteristics or measured profile shown in FIG. 9, i.e., the surface roughness average Ra=0.43 was obtained. With the ball valve main body 23, the wear of the seal ring 22 becomes smaller than 5 μm, which wear is equated to, what is obtained with the sampling R4. The sampling is rough ground by a grinding wheel of a grain size of #200 (according to Japanese Industrial Standards) and then finish ground by a grinding wheel of a grain size of #1000 (according to Japanese Industrial Standards) for thereby attaining the surface characteristics or measured profile shown in FIG. 10, i.e., the surface roughness average Ra=0.14 is obtained. In case of the sampling R3, the wear of the seal ring 22 is a maximum of 80 μm, and large flaws and leakage of fluid are caused.

In the foregoing, it is to be noted that according to the present invention the contact surface of a mechanical part is barrel finished after coarse grinding so that the profile of the contact surface has smoothly rounded peaks. Since a number of parts can be barrel finished all at once, the cost can be reduced considerably.

It is further to be noted that only the peaks of the profile are smoothly rounded and flattened, i.e., the contact surface of the mechanical part is partly flattened so that lubricant can remain in the valleys of the profile. This is effective for reducing the friction of the contact surface though the surface roughness is relatively large.

What is claimed is:

1. A ball valve comprising:

a seal ring having a fluid passage and a part-spherical contact surface; and a ceramic main body rotatably received in said seal ring and having a part-spherical ceramic contact surface in sliding contact with the contact surface of said seal ring for controlling the opening and closing of said fluid passage;

said ceramic contact surface having a profile with a roughness spacing which ranges from 5 to 100 μm and with more than half of its peaks smoothly rounded, whereby said ceramic contact surface is capable of retaining lubricant on said ceramic contact surface while providing a relatively large contact surface area.

* * * * *